US008256869B2

(12) United States Patent
Amoah-Kusi et al.

(10) Patent No.: US 8,256,869 B2
(45) Date of Patent: Sep. 4, 2012

(54) CAPACITIVE DROP MASS MEASUREMENT SYSTEM

(75) Inventors: Christian Amoah-Kusi, Portland, OR (US); David L. Knierim, Wilsonville, OR (US); James Dudley Padgett, Lake Oswego, OR (US)

(73) Assignee: Xerox Corporation, Norwalk, CT (US)

( * ) Notice: Subject to any disclaimer, the term of this patent is extended or adjusted under 35 U.S.C. 154(b) by 465 days.

(21) Appl. No.: 12/610,602

(22) Filed: Nov. 2, 2009

(65) Prior Publication Data

US 2011/0102487 A1 May 5, 2011

(51) Int. Cl.
*B41J 29/393* (2006.01)

(52) U.S. Cl. ..... 347/19; 347/8

(58) Field of Classification Search ..... 347/7, 8, 347/14, 19

See application file for complete search history.

(56) References Cited

U.S. PATENT DOCUMENTS

| | | | | |
|---|---|---|---|---|
| 5,465,619 | A | 11/1995 | Sotack et al. | |
| 6,764,168 | B1 * | 7/2004 | Meinhold et al. | 347/81 |
| 7,121,642 | B2 * | 10/2006 | Stoessel et al. | 347/19 |
| 7,556,337 | B2 | 7/2009 | Snyder | |
| 7,941,067 | B2 * | 5/2011 | Thayer et al. | 399/71 |
| 2003/0011663 | A1 * | 1/2003 | Sarmast | 347/81 |
| 2007/0146459 | A1 | 6/2007 | Gault et al. | |
| 2008/0112716 | A1 | 5/2008 | Jeschonek | |
| 2009/0096823 | A1 | 4/2009 | Watt et al. | |
| 2010/0104310 | A1 * | 4/2010 | Thayer et al. | 399/71 |

* cited by examiner

*Primary Examiner* — Charlie Peng
(74) *Attorney, Agent, or Firm* — Maginot, Moore & Beck, LLP

(57) ABSTRACT

An imaging device includes an image receiving surface movably supported within the imaging device and at least one printhead having a plurality of ink jets, each ink jet being configured to eject drops of ink on the image receiving surface. At least one sensing electrode is positioned adjacent the image receiving surface that outputs capacitance signals indicative of a capacitance in a gap between the at least one sensing electrode and image receiving surface that are output to a controller. The imaging device includes a drop mass detection mode of operation in which: at least one ink jet in the plurality of ink jets is actuated to eject drops of ink to form at least one test band on the image receiving surface; the image receiving surface is moved so that the at least one test band of ink is positioned in the gap; the at least one sensing electrode outputs a test band capacitance signal indicative of a capacitance with the at least one test band in the gap; and the controller modifies an operating parameter of the imaging device based on the capacitance indicated by the test band capacitance signal.

17 Claims, 10 Drawing Sheets

CAPACITIVE DROP MASS MEASUREMENT SYSTEM

TECHNICAL FIELD

The present disclosure relates to imaging devices that utilize printheads to eject drops to form images on media.

BACKGROUND

Imaging devices, such as ink jet printers, typically include one or more printheads each having a plurality of ink jets from which drops of ink are ejected towards an image receiving member to form images. The receiving member may be recording media or it may be a rotating intermediate imaging member, such as a print drum or belt. In a printhead, individual piezoelectric, thermal, or acoustic actuators in the ink jets generate mechanical forces that expel ink drops through an ink jet nozzle or orifice in response to an electrical voltage signal, sometimes called a driving signal. The amplitude, or voltage level, of the signals affects the amount of ink ejected in each drop. Images are formed on the receiving member by selectively activating the actuators of the ink jets to eject drops in timed registration with the relative movement of the receiving member with respect to the printhead(s).

The image quality of the images produced by an imaging device is determined in part by the drop mass of the drops generated by the ink jets. Image quality may be degraded if the ink jets of the printheads produce drops having drop mass that is not within specification or if they have inconsistent drop mass from jet to jet, or printhead to printhead. As part of a setup or maintenance routine, the printheads of an imaging device may undergo a normalization or calibration process so that the ink jets of the printheads produce ink drops having substantially uniform drop mass within desired specifications. Normalization of the ink jets of the printheads may be accomplished by modifying the driving signals that are used to activate the actuators of the jets. To enable normalization of the drop mass of the drops produced by the ink jets, the drop mass must first be determined. Knowledge of the drop mass enables calibration of the driving signals for the ink jets so that the ink jets of the printheads produce drops having substantially the same drop mass.

In previously known systems, however, the drop mass of drops emitted by a printhead or printheads of an imaging device was determined by printing onto transparencies and measuring the weight difference before and after the ink is transfixed to the sheets. The weight difference between the printed and non-printed sheets corresponds to the total weight of the ink on the sheet which is then divided by the total number of drops printed onto the sheet to arrive at the average drop mass for the printhead or printheads used to print onto the transparencies. Based on the determined average drop mass using the printed transparencies, the drive signals for actuating the ink jets of the printheads may be calibrated to adjust the drop mass of the drops produced by a printhead to be within specifications. While such a method of determining average drop mass is effective, such techniques are typically only available for use at the factory, not in the field. In addition, it may take several iterations and huge amounts of resources, i.e., time, transparencies, and ink, to calibrate the overall drop mass in a printhead.

SUMMARY

A drop mass measurement system has been developed that may be incorporated into an imaging device and that enables the detection of the average drop mass of drops of ink emitted by a printhead or printheads of an imaging device. The drop mass measurement system includes a capacitance sensor that is configured to detect the thickness of test bands of ink deposited onto an imaging member in the imaging device. The detected thickness of the test bands corresponds to the drop mass of the drops of ink that form the test band. By incorporating a capacitive drop mass measurement system into the imaging device, drop mass may be detected and calibrated on location automatically without user intervention or requiring a service call to a technician.

In one embodiment, an imaging device includes an image receiving surface movably supported within the imaging device and at least one printhead having a plurality of ink jets, each ink jet being configured to eject drops of ink on the image receiving surface. At least one sensing electrode is positioned adjacent the image receiving surface that outputs capacitance signals indicative of a capacitance in a gap between the at least one sensing electrode and image receiving surface that are output to a controller. The imaging device includes a drop mass detection mode of operation in which: at least one ink jet in the plurality of ink jets is actuated to eject drops of ink to form at least one test band on the image receiving surface; the image receiving surface is moved so that the at least one test band of ink is positioned in the gap; the at least one sensing electrode outputs a test band capacitance signal indicative of a capacitance with the at least one test band in the gap; and the controller correlates the test band capacitance indicated by the test band capacitance signal to a drop mass value.

In another embodiment, a method of operating a printhead of an imaging device includes positioning a capacitance sensor adjacent an image receiving surface of an imaging device. The capacitance sensor is configured to detect a capacitance in a gap between the capacitance sensor and the image receiving surface. Drops of ink from at least one ink jet of at least one printhead of the imaging device are then ejected to form a layer of ink on the image receiving surface. A capacitance in the gap is then detected with the layer of ink therein using the capacitance sensor. The detected capacitance is then correlated to a drop mass value for the at least one ink jet used to form the test band.

DETAILED DESCRIPTION

Figure 1:
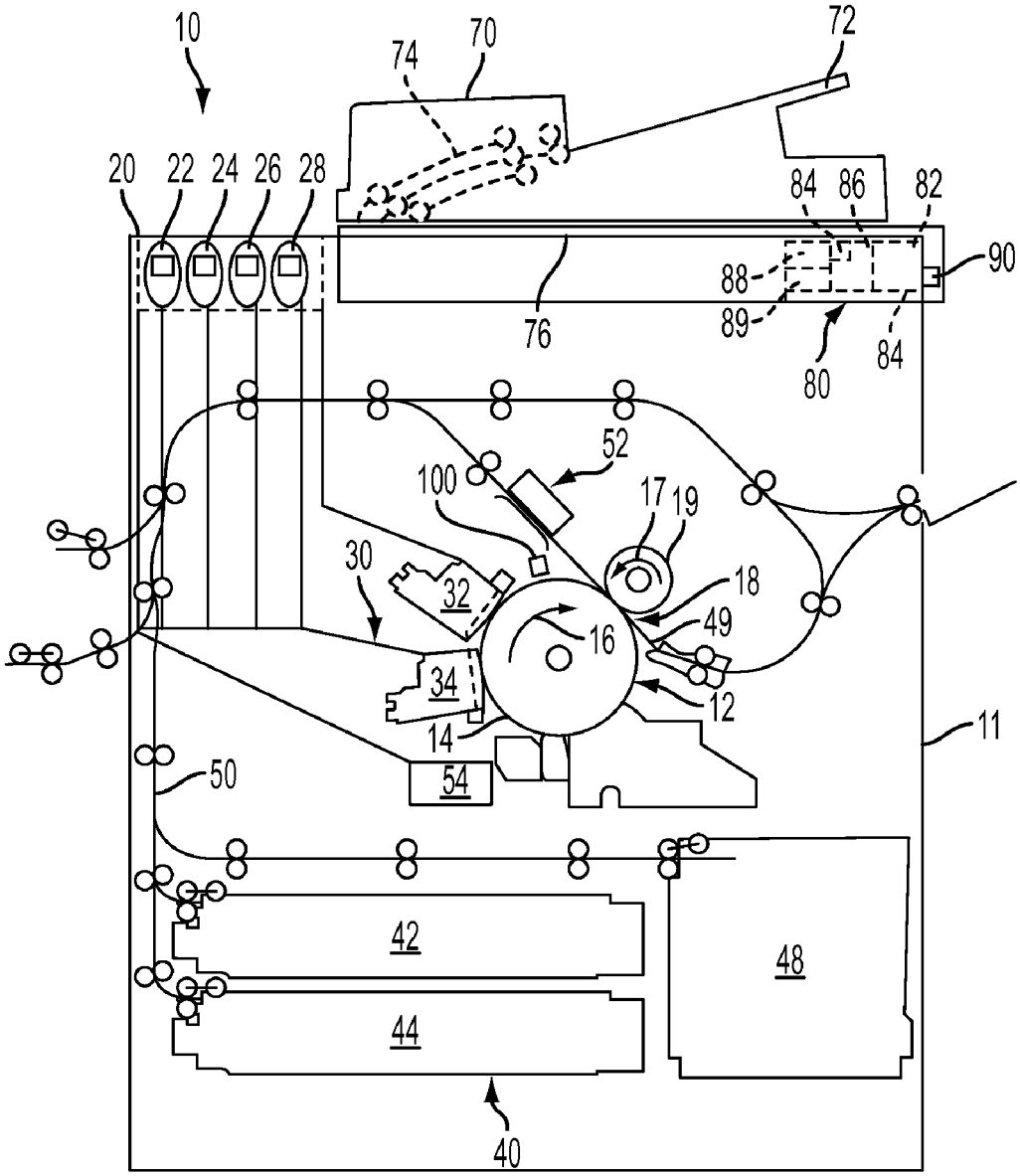
FIG. 1 is a schematic elevational view of an embodiment of an imaging device.
Figure 2:
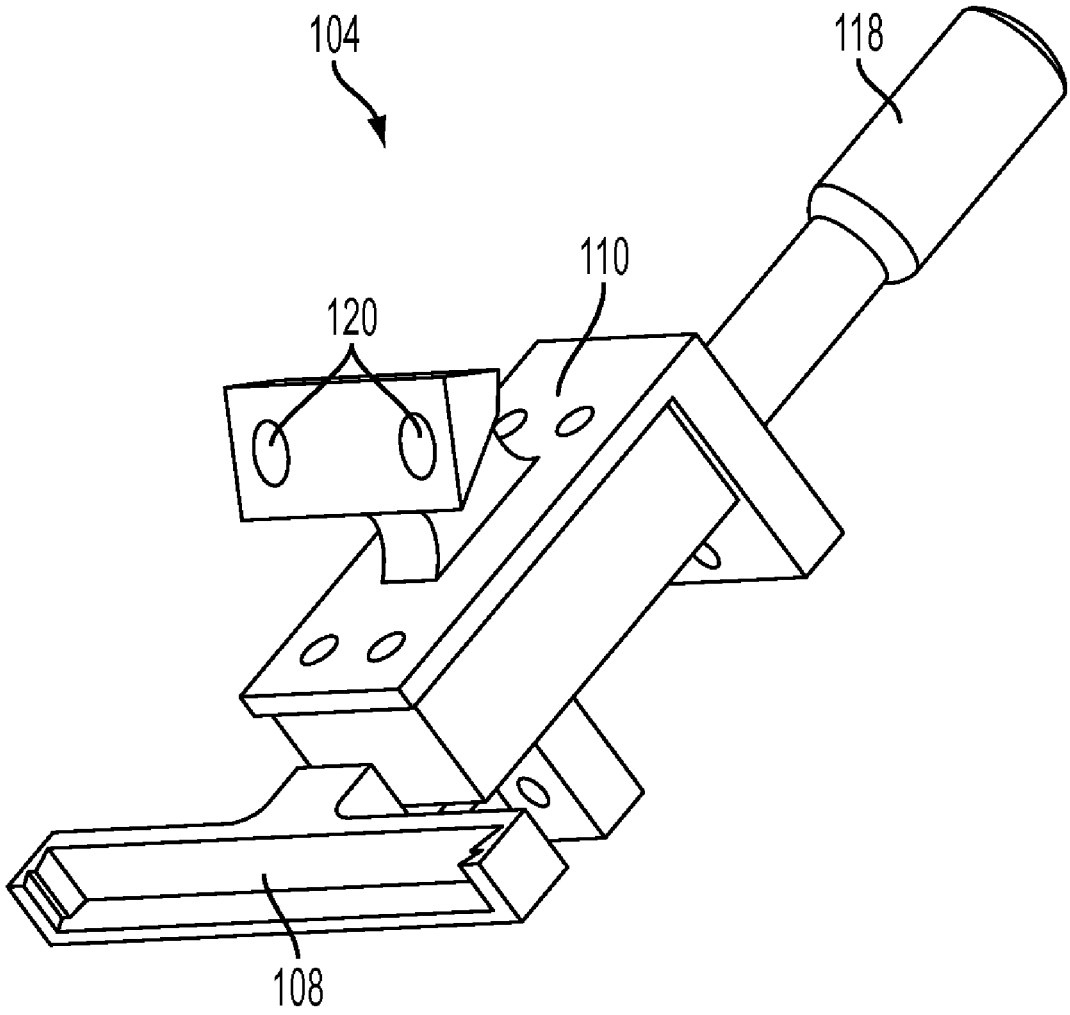
FIG. 2 is a perspective view of an embodiment of a capacitance sensor of a capacitive drop mass detection system that may be incorporated into the imaging device of FIG. 1.

For a general understanding of the present embodiments, reference is made to the drawings. In the drawings, like reference numerals have been used throughout to designate like elements.

As used herein, the terms "printer" or "imaging device" generally refer to a device for applying an image to print media and may encompass any apparatus, such as a digital copier, bookmaking machine, facsimile machine, multi-function machine, etc. which performs a print outputting function for any purpose. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multifunction machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like. As used herein, the process direction is the direction in which the substrate onto which the image is transferred moves through the imaging device. The cross-process direction, along the same plane as the substrate, is substantially perpendicular to the process direction.

Referring now to FIG. 1, an embodiment of an imaging device 10 of is depicted. The device 10 includes a frame 11 to which are mounted directly or indirectly all its operating subsystems and components, as described below. In the embodiment of FIG. 1, imaging device 10 is an indirect marking device that includes an intermediate imaging member 12 that is shown in the form of a drum, but can equally be in the form of a supported endless belt. The imaging member 12 has an image receiving surface 14 that is movable in the direction 16, and on which phase change ink images are formed. A transfix roller 19 rotatable in the direction 17 is loaded against the surface 14 of drum 12 to form a transfix nip 18, within which ink images formed on the surface 14 are transfixed onto a media sheet 49. In alternative embodiments, the imaging device may be a direct marking device in which the ink images are formed directly onto a receiving substrate such as a media sheet or a continuous web of media.

The imaging device 10 also includes an ink delivery subsystem 20 that has at least one source 22 of one color of ink. Since the imaging device 10 is a multicolor image producing machine, the ink delivery system 20 includes four (4) sources 22, 24, 26, 28, representing four (4) different colors CYMK (cyan, yellow, magenta, black) of ink. In one embodiment, the ink utilized in the imaging device 10 is a "phase-change ink," by which is meant that the ink is substantially solid at room temperature and substantially liquid when heated to a phase change ink melting temperature for jetting onto an imaging receiving surface. Accordingly, the ink delivery system includes a phase change ink melting and control apparatus (not shown) for melting or phase changing the solid form of the phase change ink into a liquid form. The phase change ink melting temperature may be any temperature that is capable of melting solid phase change ink into liquid or molten form. In one embodiment, the phase change ink melting temperate is approximately 100° C. to 140° C. In alternative embodiments, however, any suitable marking material or ink may be used including, for example, aqueous ink, oil-based ink, UV curable ink, or the like.

The ink delivery system is configured to supply ink in liquid form to a printhead system 30 including at least one printhead assembly 32. Since the imaging device 10 is a high-speed, or high throughput, multicolor device, the printhead system 30 includes multicolor ink printhead assemblies 32, 34. Each printhead assembly includes a plurality of ink jets (not shown) that are configured to eject drops of ink onto the surface 14 of the imaging member 12 to form an image. Although two printhead assemblies 32, 34 are shown in FIG. 1, any suitable number of printhead assemblies may be utilized.

As further shown, the imaging device 10 includes a media supply and handling system 40. The media supply and handling system 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling system 40 also includes a substrate or sheet heater or preheater assembly 52. The imaging device 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes a sensor input and control system 88 as well as a pixel placement and control system 89. In addition the CPU 82 reads, captures, prepares and manages the image data flow between image input sources such as the scanning system 76, or an online or a work station connection 90, and the printhead assemblies 32, 34. As such, the ESS or controller 80 is the main multi-tasking processor for operating and controlling all of the other machine subsystems and functions. The controller generates control signals that are delivered to the components and subsystems. These control signals, for example, include drive signals for actuating the ink jets of the printheads to eject drops to form images on the surface of the imaging member.

In operation, image data for an image to be produced are sent to the controller 80 from either the scanning system 76 or via the online or work station connection 90 for processing and output to the printhead assemblies 32, 34. Additionally, the controller determines and/or accepts related subsystem and component controls, for example, from operator inputs via the user interface 86, and accordingly executes such controls. As a result, appropriate color solid forms of phase change ink are melted and delivered to the printhead assemblies. Additionally, the controller generates appropriate drive signals for the ink jets of the printheads pixel placement control is exercised relative to the imaging surface 14 and appropriate drive signals generated for actuating the ink jets of the printheads to form images on the surface 14 of the imaging member per such image data, and receiving substrates are supplied by any one of the sources 42, 44, 48 along supply path 50 in timed registration with image formation on the surface 14. Finally, the image is transferred from the surface 14 and fixed to the copy sheet within the transfix nip 18.

As mentioned above, an important factor in the quality of the images produced by the imaging device is the drop mass of the drops produced by the ink jets. Accordingly, the imaging device 10 is provided with a capacitive drop measurement system 100 that may be incorporated into the housing of the imaging device 10 and that enables the detection of the thickness of ink deposited on the surface 14 of the imaging drum 12. As explained below, the detected thickness may be correlated to the average drop mass of drops of ink emitted by a printhead or printheads of an imaging device. Based on the detected average drop mass, one or more operating parameters of the printheads or ink jets of the printheads may be adjusted or modified so that the ink jets produce drops with a desired drop mass. For example, the drive signals for actuating the ink jets of the printheads may be calibrated to adjust the drop mass of the drops produced by a printhead to be within specifications. In one embodiment, the drop mass of drops output by the ink jets may be calibrated by increasing the voltage level, or amplitude, of the drive signals for the ink jets to increase drop mass and by decreasing the voltage level, or amplitude, of the drive signals for the ink jets to decrease drop mass. By incorporating a capacitive drop mass measurement system 100 into the imaging device, drop mass may be detected and calibrated on location automatically without user intervention or requiring a service call to a technician.

FIGS. 2, 3, 4A, and 4B illustrate one embodiment of a capacitive drop mass measurement system 100 that may be incorporated into the imaging device 10. As depicted, the system 100 includes a capacitance sensor 104 and a controller 114. The capacitance sensor has at least one sensing electrode 108 and an electrode support frame 110 configured to position the sensing electrode 108 at a fixed distance D from the surface 14 of the imaging drum. The sensing electrode 108 is configured to generate capacitance signals indicative of the capacitance between the sensing electrode 108 and the drum surface 14 positioned under the sensing electrode 108 in the gap G at the time of the capacitance measurement. The capacitance signals are output to a controller 114. The capacitance signals generated by the sensing electrode may take any form that enables the controller 114 to derive the capacitance in the gap G.

Figure 4A:
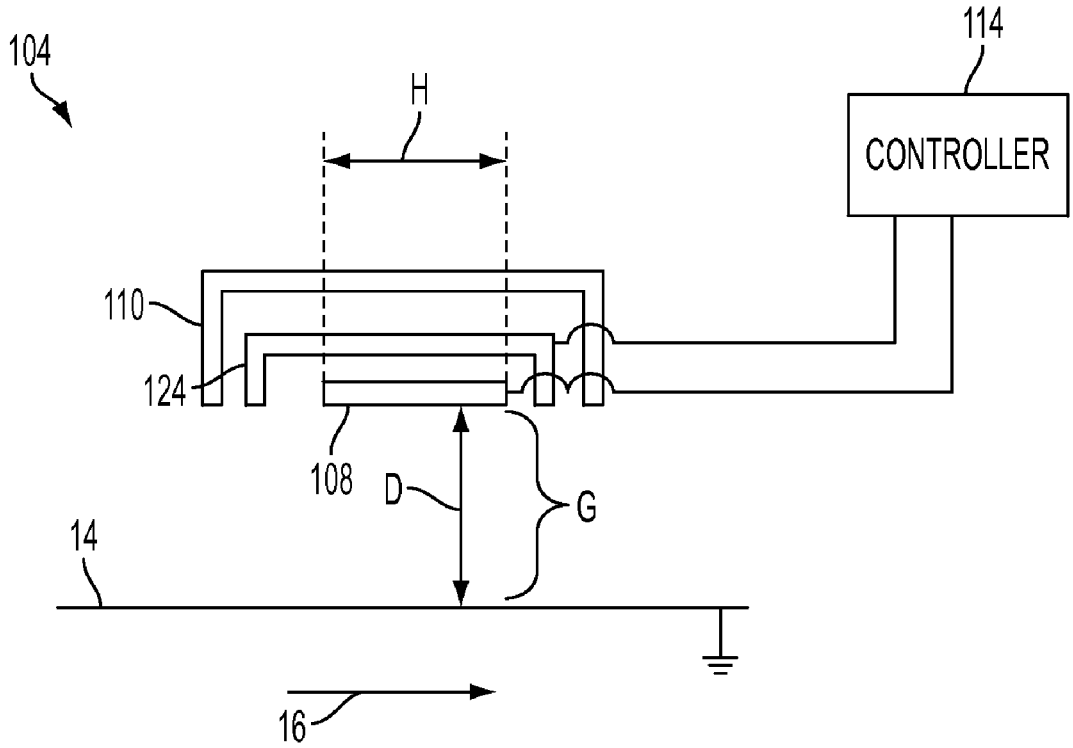
FIG. 4A is a schematic view of the capacitive drop mass detection system of FIGS. 2 and 3.
Figure 4B:
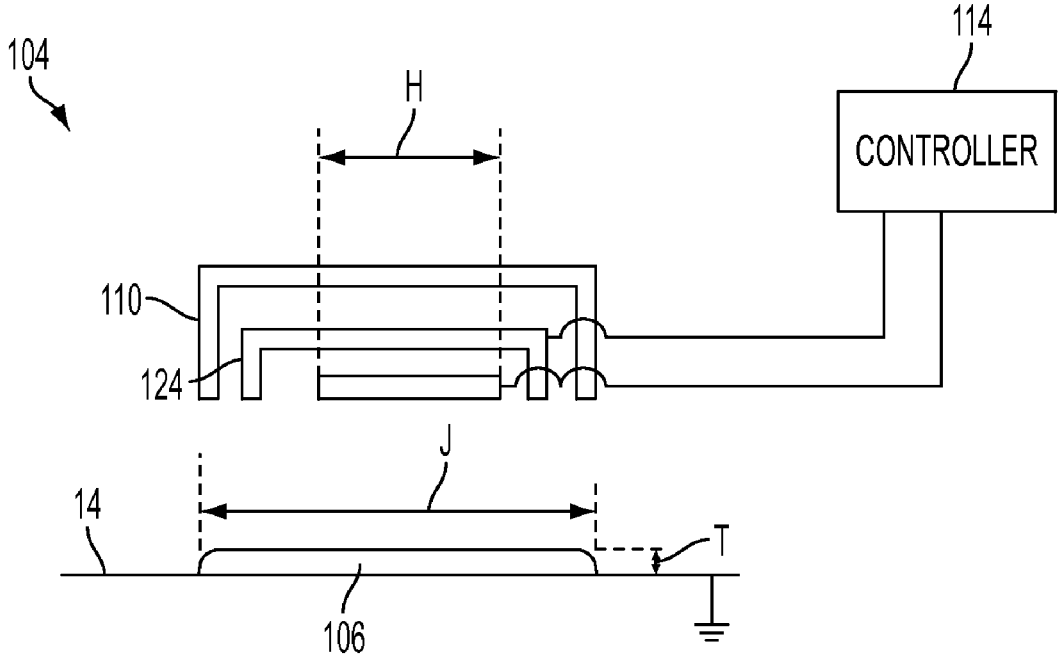
FIG. 4B is a schematic view of the capacitive drop mass detection system of FIGS. 2 and 3 with a test band of ink positioned under the sensing electrode of the capacitance sensor.
Figure 5:
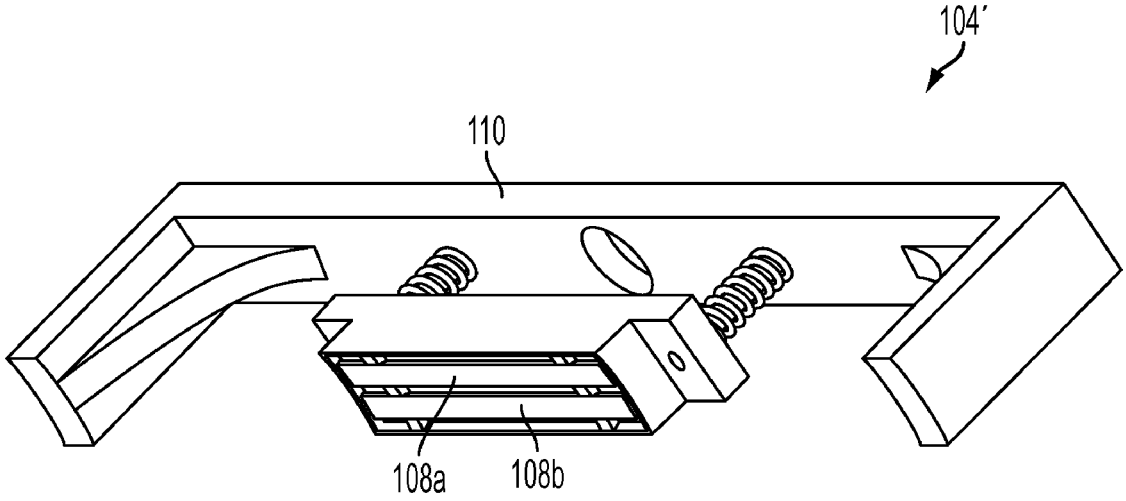
FIG. 5 is a perspective view of another embodiment of a capacitance sensor of a capacitive drop mass detection system that may be incorporated into the imaging device of FIG. 1.
Figure 6:
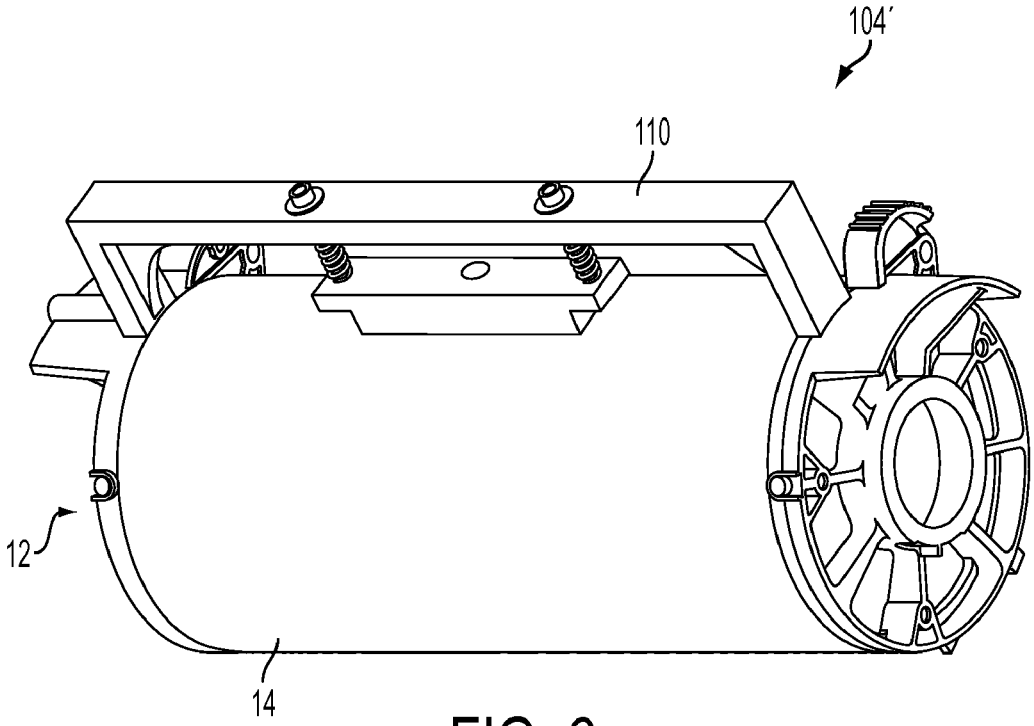
FIG. 6 is a perspective view of the capacitance sensor of FIG. 5 positioned adjacent the imaging drum of the imaging device of FIG. 1.

As best seen in FIGS. 4A and 4B, the capacitance sensor 104 includes a single sensing electrode 108, although, as explained below, two or more sensing electrodes may be utilized. When multiple sensing electrodes are used, each sensing electrode may be configured to output separate capacitance signals to the controller 114 which the controller may then average in a suitable manner to derive the thickness measurement for the test band and corresponding average drop mass. As used herein, the term "electrode" may refer to any electrical conductor capable of transporting an electrical current.

In one embodiment, the sensing electrode comprises a metal plate, although any suitable conductive material may be utilized for the electrode. The dimensions of the sensing electrode(s) 108, such as the height H and the distance D, as well as the dimensions of the test bands of ink formed on the surface of the drum are selected to enable the detection of capacitance while minimizing noise that may be introduced into the capacitance measurement. For example, as shown in FIG. 4B, a test band 106 may have a height J following the circumference of the surface 14 of the drum 12 that is greater than the sensing electrode height H so that the electric field generated by the sensing electrode 108 does not wrap around the sides of the test band 106 and introduce error into the capacitance measurement. In one embodiment, the electrode has a height H of approximately 5 mm, and is positioned a distance D from the surface of approximately 1 mm. In this embodiment, the test band may be printed with a height J that is greater than 5 mm, and in one particular embodiment, the height J of the test band 106 is approximately 8 mm. Sensing electrodes 108 have a width (not shown) that spans at least a portion of the drum surface 14 in the cross-process direction (X axis). In one embodiment, the width of the sensing electrode is approximately 79 mm. Any suitable dimensions for the sensing electrodes and test bands, however, may be utilized.

Figure 3:
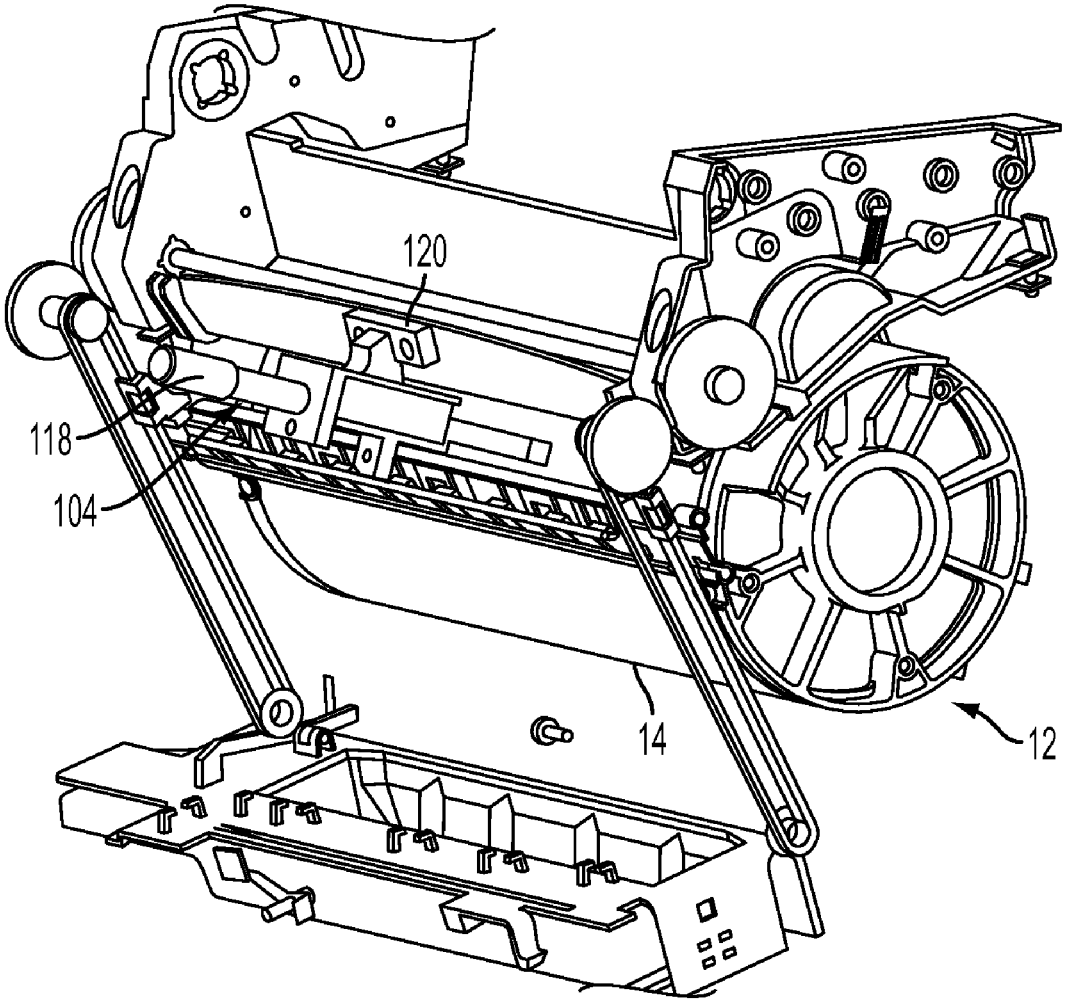
FIG. 3 is a perspective view of the capacitance sensor of FIG. 2 positioned adjacent the imaging drum of the imaging device of FIG. 1.

The support frame 110 may have any suitable construction and may be formed of any suitable material or materials, such as plastic, capable of positioning the sensing electrode(s) 108 the fixed distance D from the drum surface. FIG. 3 is a perspective view one embodiment of a capacitance sensor support frame 110 shown positioned adjacent the surface 14 of an imaging member 12. As depicted, the support frame 110 may include a positioning apparatus 118, such as turn knob, to which the sensing electrode (not shown in FIG. 3) is operably attached that enables adjustment of the distance of the sensing electrode relative to the surface of the drum. In addition, the support frame 110 may include features, such as fastener openings 120 and fasteners (not visible), that enable the capacitance sensor support frame 110 to be mounted at any suitable location within the housing of the imaging device.

The surface 14 of the imaging drum is formed of an electrically conductive material, such as anodized aluminum, and is connected to ground potential which enables the sensing electrode 108 to detect a capacitance in the gap G between the electrode 108 and the surface 14 of the drum. In the exemplary embodiments of FIGS. 4A and 4B, the sensing electrode 108 is arranged substantially perpendicular to the radius of the drum and extends parallel to the longitudinal axis of the drum. However, the sensing electrode 108 may be arranged in any suitable manner with respect to the drum surface 14 that enables capacitance measurements to be taken in the gap between the electrode and the drum surface. Please note that the surface 14 is depicted in FIGS. 4A and 4B as being substantially flat, but, in actuality, the surface 14 may be curved, such as the surface of a drum, or have other suitable non-linear shapes.

To prevent the electric field generated by the sensing electrode 108 from reaching beyond the intended target area on the surface 14 of the drum, the capacitive sensor 104 may be provided with a shield electrode 124. The shield electrode 124 is positioned behind (and in some embodiments to the sides) of the sensing electrode 108 to block electric fields from surrounding components from interfering with the capacitance measurement by the sensing electrode. The shield electrode 124 comprises a conductive metal plate that is kept at the same voltage as the sensing electrode 108. Because there is no difference in voltage between the sensing electrode 108 and the shield electrode 124, there is no electric field between them to interfere with the capacitance measurement in the gap G. In addition, any conductors beside or behind the shield electrode form an electric field with the shield electrode instead of the sensing electrode. In alternative embodiments in which there is not expected to be much interference from surrounding components in the imaging device, the shield electrode 124 may be removed or eliminated from the capacitive sensor.

The controller 114 may be implemented with general or specialized programmable processors that execute programmed instructions. The instructions and data required to perform the programmed functions may be stored in memory associated with the processors. The processors, their memories, and interface circuitry enable the controller perform functions, such as drop mass measurement based on the capacitance signals received from the sensing electrode. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits. In one embodiment, the controller 114 may form a part of the overall system controller 80 for the imaging device 10, although it may be independent from the controller 80.

In order to determine the average drop mass of drops emitted by the printheads of an imaging device using the capacitance sensor, the imaging device 10 is configured to enter a drop mass detection mode of operation. The drop mass detection mode may be activated in any suitable manner and at any suitable time. For example, drop mass detection and calibration may be offered as a user selectable option through the user interface 86 or through a remote device, such as a computer, attached to the imaging device over a network. In addition, the drop mass detection mode may be automatically implemented by the controller and performed on a regularly scheduled basis.

In the drop mass detection mode, the ink jets of the printhead assemblies 32, 34 are actuated to eject drops onto the surface 14 of the drum 12 to form one or more test patterns, or test bands 106. In one embodiment, a test band 106 is printed by actuating each jet in one or more rows of jets (rows extend in the cross-process direction of the imaging member) of a printhead to form a layer of ink on the surface of the drum having a width in the cross-process direction corresponding substantially to the width of the printhead. Surface energy properties of the ink and the drum surface 14 cause the ink drops to coalesce to a substantially uniform thickness that corresponds substantially to the drop mass of the drops used to form the test band.

Once one or more test bands have been formed on the image receiving surface 14, the image receiving surface 14 is actuated so that the test band or bands are moved under the sensing electrode 108 as depicted in FIG. 4B. The capacitance in the gap G when there is no ink on the surface 14 under the sensing electrode 108 (FIG. 4A) corresponds to a baseline capacitance. When a test band of ink 106 is on the surface 14 under the electrode 108 (FIG. 4B), the capacitance in the gap G is changed relative to the baseline capacitance by an amount that is proportional to the thickness T of the test band. With knowledge of the baseline capacitance and the capacitance with a test band on the drum surface 14 under the electrode 108 as well as the dielectric constant of the ink used to form the test band, the controller 114 may determine the thickness of the test band. In one embodiment, the baseline capacitance may be detected in conjunction with the ink capacitance for example by moving an un-inked portion of the drum under the sensing electrode prior to or after the ink capacitance is detected. The baseline capacitance, however, may be detected or determined at any suitable time.

As mentioned above, the thickness T of a test band on the surface 14 corresponds to the drop mass of the drops used to form the test band. Therefore, the thickness of the test band indicated by the capacitance sensor may be correlated by the controller 114 to an average drop mass for the printheads, or ink jets of the printheads, use to form the test band on the surface 14. Any suitable method may be used by the controller to derive the test band thickness and corresponding average drop mass value based on the capacitance signals generated by the sensing electrode 108.

One algorithm for converting capacitance readings into drop mass values involves converting the capacitance signals generated by the sensing electrode into the electrode-to-drum distance that would be required to generate that capacitance. An example of a function that may be used to convert capacitance into electrode-to-drum distance for the sensor embodiment of FIGS. 4A and 4B is given by:

$$d=(3.88/c)+(3.97/(c*c))-(3.6/(c*c*c))$$

where "c" is the capacitance in picofarads (pF) and "d" is the electrode-to-drum distance in millimeters (mm). As is known in the art, correction coefficients may be used in calculating distances to compensate for factors such as fringe field effects that may alter capacitance readings.

Using the above formula, the baseline capacitance may be converted to a distance value that corresponds to the distance between the sensing electrode and the drum surface, also referred to as electrode-to-drum distance $D_1$. The capacitance with a test band in the gap G, also referred to as the test band capacitance, may be converted to an "apparent" distance value that corresponds to the distance between the sensing electrode and the drum surface with a test band positioned therebetween, also referred to as the electrode-to-ink distance $D_2$. The term "apparent" is used in this regard to denote the fact that the actual electrode-to-drum distance has not changed relative to the electrode-to-drum distance $D_1$. Rather, the "apparent" distance refers to a distance indicated by the capacitance measurement that results from the change in dielectric in the gap G due to the presence of the test band.

Once the electrode-to-drum distance $D_1$ and the electrode-to-drum distance $D_2$ have been calculated, an apparent distance reduction value $T_c$ may be determined by subtracting $D_2$ from $D_1$, where $T_c=(D_1-D_2)$. A test band on the drum surface under the electrode 108 reduces the apparent distance from the electrode to drum by:

$$T_C=T_I*(1.0-(1.0/ei))$$

where "$T_C$" is the apparent distance reduction, "$T_I$" is the actual thickness of the ink layer, and "ei" is the dielectric constant of the ink. The apparent distance reduction $T_C$ is then inserted into the above equation to calculate the actual thickness of the ink layer $T_I$ based on a known ink dielectric constant "ei" such that $T_I=T_C/(1.0-(1.0/ei))$.

Once the actual thickness $T_I$ of the test band has been derived, the actual thickness $T_I$ may be used to calculate an average drop mass value $D_m$. If $T_I$ is in mm, R is the image resolution in drops-per-square-cm, and $D_i$ is the density of ink in grams-per-cubic-cm, then the drop mass $D_m$ in nano-grams per drop is:

$$D_m=1E8*T_i*D_i/R.$$

In alternative embodiments, the controller may include a processor for implementing any other suitable algorithm for calculating the average drop mass based on the detected base line capacitances and ink capacitances.

Once the average drop mass for a printhead or printheads of the imaging device is determined, a determination may be made whether the average drop mass is within specifications. For example, the controller may be configured to compare the average drop mass to predetermined threshold values to determine if the drop mass is too great or too small relative to the desired drop mass. If the average drop mass is determined to not be within specifications, the controller may be configured to adjust the voltage level or amplitude of all or a portion of the driving signal for the ink jets of the printhead or printheads until the average drop mass for the printhead or printheads is within desired specifications. The modification of the drive signals based on the average drop mass detected using the capacitive drop mass measurement system may require iterations. For example, once the average drop mass for the printhead(s) of an imaging device has been determined and modifications made to the drive signals to adjust the average drop mass, more test bands may be printed and the capacitance measured to determine if the adjustments were successful. The process may be repeated any suitable number of times until the average drop mass output by a printhead is within a desired range.

The one or more test bands formed on the drum surface 14 may be moved with respect to the sensing electrodes of the capacitance sensor in any suitable manner that enables the capacitance in the gap between the sensing electrodes and the drum surface to be detected or measured. For example, in one embodiment, the controller 80 is configured to rotate the imaging member 12 until a test band is positioned under the sensing electrode 108 and to stop the rotation of the drum for a predetermined amount of time while the test band capacitance is being measured by the sensing electrode. Similarly, the controller may be configured to rotate the imaging member 12 until a bare or un-inked area on the surface 14 of the drum is positioned under the sensing electrode and to stop the rotation of the drum for a predetermined amount of time while the base line capacitance is being measured by the sensing electrode 108.

Depending on the configuration and interaction of the internal components of the imaging device, however, stopping and starting the rotation of the imaging member may introduce noise into the capacitance measurement and result in inaccurate average drop mass determination. For example, drum radial position depends on such "random" variables as motor drive belt force, bearing ball locations, temperature of drum end bells and frame, etc., collectively referred to herein as non-repeatable drum run out. Non-repeatable drum run out may alter the electric field between the sensing electrode and the drum surface causing the capacitance measurements to vary in an unpredictable manner thereby making drop mass determinations unreliable.

In order to overcome or reduce the effects of noise, such as non-repeatable drum run out, that may be introduced into the capacitance measurement, the controller may be configured to slew, or rotate, the drum, (with one or more test bands formed thereon) at a predetermined rate of speed for a predetermined number of revolutions of the drum while the sensing electrode(s) 108 generates capacitance data indicative of the test band capacitance and the base line capacitance. A bandpass filter (not shown) may be applied to the capacitance signals to subtract any noise in the system. Generating capacitance data as the drum 12 is slewed for multiple revolutions enables multiple measurements of the test band capacitance and base line capacitance to be made which may then be averaged to arrive at an average test band capacitance and an average base line capacitance. The average test band capacitance and the average baseline capacitance may then be used to determine the thickness of the test band layer and average drop mass corresponding to the determined test band thickness.

While the average drop mass is capable of being determined using a single test band and slewing the drum around multiple times to generate multiple measurements of the test band capacitance and baseline capacitance, the capacitance measurement may be made even more robust by utilizing multiple sensing electrodes 108 and/or multiple test bands formed on the drum surface. The use of multiple test bands and/or sensing electrodes enables more capacitance measurements to be made in the same amount of time relative to the case of a single sensing electrode and test band albeit at the cost of increased ink consumption in the case of multiple test bands. In embodiments in which multiple test bands are formed on the drum, the test bands are formed on the surface of the drum with a predetermined spacing that enables the sensing electrodes 108 to be positioned over the bare surface areas of the drum between the test bands without ink in the sensing area under the electrode. In one embodiment, the predetermined spacing between test bands may be the same as the height J of the test band. Similarly, the sensing electrodes 108 in embodiments in which multiple sensing electrodes are used are spaced far enough apart so that a test band positioned under one sensing electrode does not interfere with the capacitance measurement by another sensing electrode.

Referring now to FIGS. 5, 6, 7A, and 7B, another embodiment of a capacitive drop mass measurement system 100' is depicted. The system 100' of FIGS. 5, 6, 7A, and 7B is similar to the system 100 described above in relation to FIGS. 2, 3, 4A, and 4B except the system shown in FIGS. 5, 6, 7A, and 7B utilizes a capacitance sensor 104' having two electrodes, also referred to as a dual electrode capacitance sensor 104'. FIG. 8 is a flowchart of an embodiment of a method of operating the capacitive drop measurement system 100' depicted in FIGS. 5, 6, 7A, and 7B. As explained below, the capacitive drop mass measurement system 100' and corresponding method of operation enable test band thickness (and corresponding drop mass) measurements that are less susceptible to errors that may be introduced due to, for example, non-repeatable drum run out while only requiring a single test band formed on the drum surface thereby reducing the amount of ink required to determine drop mass.

Similar to the single electrode capacitance sensor described above, the dual electrode capacitance sensor 104' includes a support frame 110 configured to position each sensing electrode 108 at a fixed distance from the surface of the imaging drum. The support frame 110 may have any suitable construction and may be formed of any suitable material or materials, such as plastic, capable of fixedly positioning the sensing electrode relative to the drum surface without interfering with capacitance measurement. In addition, the support frame may include features that enable the capacitance sensor support frame to be mounted at any suitable location within the housing of the imaging device.

Figure 7A:
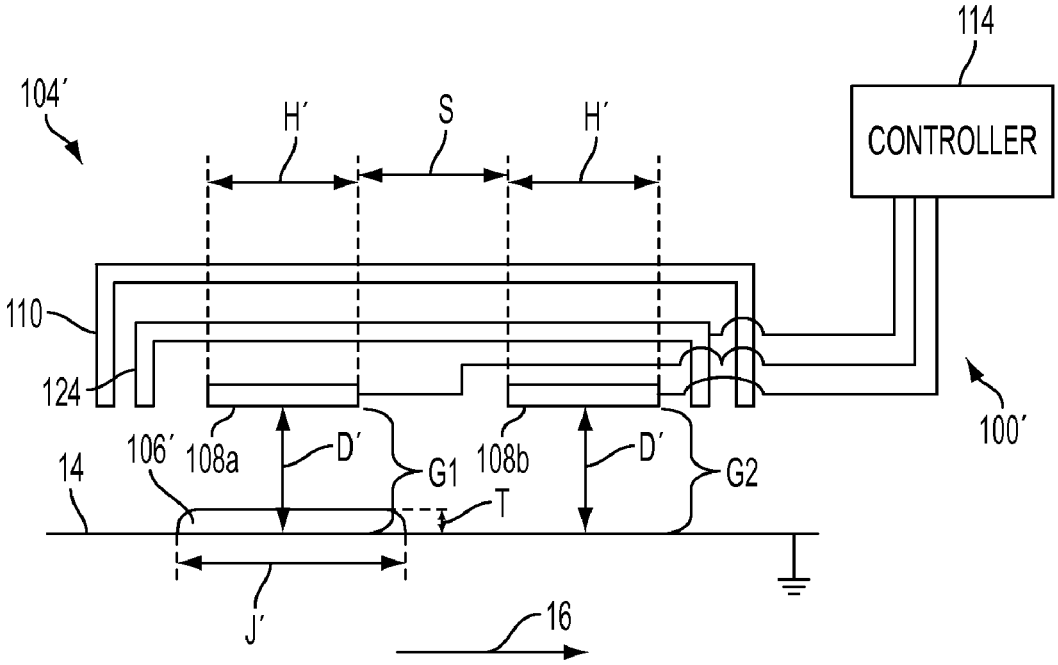
FIG. 7A is a schematic view of the capacitance sensor of FIG. 6 with a test band positioned under one of the two sensing electrodes.
Figure 7B:
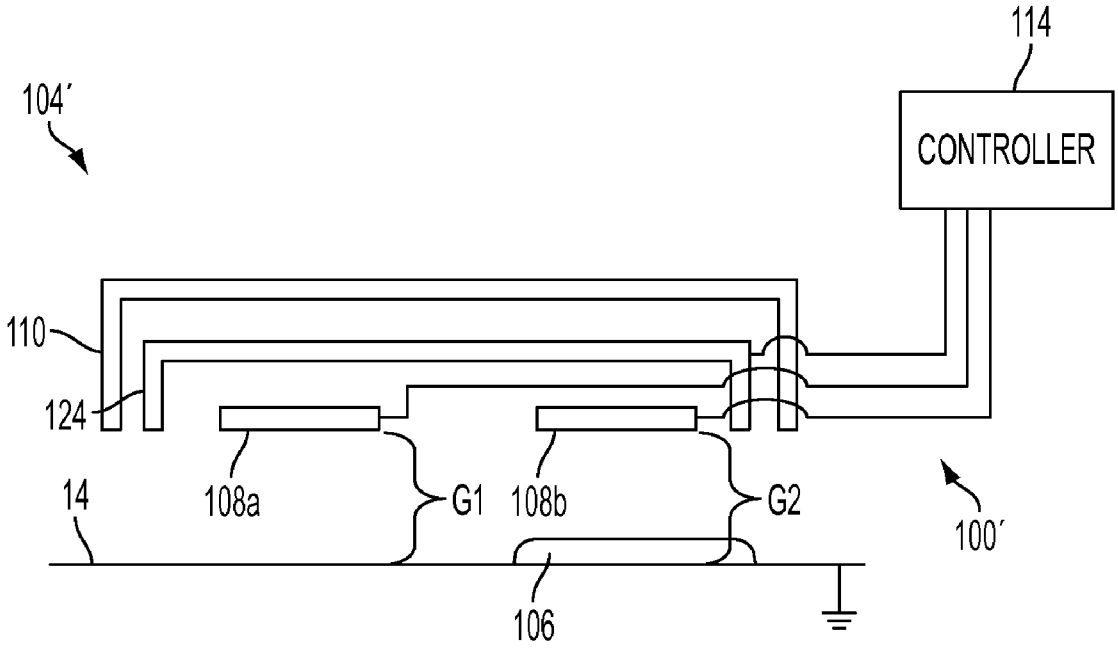
FIG. 7B is a schematic view of the capacitance sensor of FIG. 6 with a test band positioned under the other of the two sensing electrodes.
Figure 8:
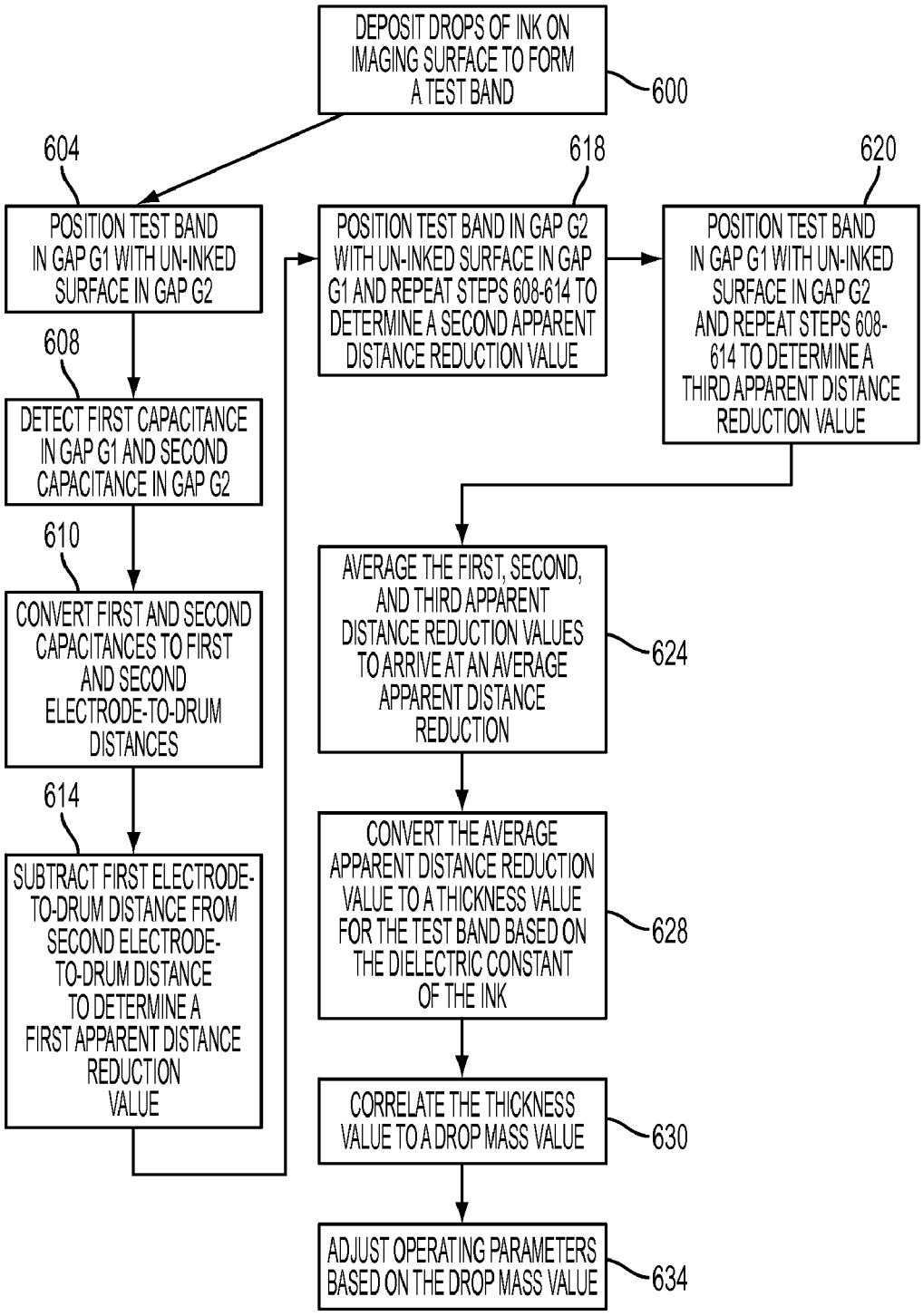
FIG. 8 is a flowchart of a method of operating the capacitive mass detection system of FIG. 5.

As best seen in FIGS. 7A and 7B, the capacitive sensor 104' includes two sensing electrodes 108*a*, 108*b* that are arranged at different circumferential positions around the drum surface 14. The dimensions of the sensing electrodes 108*a*, 108*b* and spacing between electrodes 108*a*, 108*b* of the dual electrode capacitance sensor as well as the dimensions of the test band of ink formed on the surface of the drum for use with the dual electrode capacitance sensor are selected to enable the detection of capacitance in the gaps G1 and G2 while minimizing noise that may be introduced into the capacitance measurement. In one embodiment, the electrodes each have a height H' of approximately 4 mm and are spaced from each other by a distance S of approximately 4 mm. The distance D' between each of the electrodes 108*a*, 108*b* and the drum surface 14 in the gaps G1 and G2 is in the range from approximately 0.5 mm to 1.3 mm. In this embodiment, the test band 106 may be printed with a height J' that enables the test band 106 to be positioned under one of the electrodes 108*a*, 108*b* without interfering with capacitance measurements of the other electrode. For example, in one embodiment, the test band has a height J' of approximately 8 mm. Any suitable dimensions for the sensing electrodes and test bands, however, may be utilized.

In the embodiment of FIGS. 7A and 7B, each sensing electrode 108*a*, 108*b* is configured to generate capacitance signals indicative of the capacitance in the respective gap G1 and gap G2. The controller 114 is operably coupled to the sensing electrodes 108*a*, 108*b* to receive the capacitance signals from each of the sensing electrodes 108*a*, 108*b*. The capacitance signals generated by the sensing electrodes 108*a*, 108*b* may take any form that enables the controller 114 to derive the capacitances in the respective gaps G1 and G2. Similar to the embodiment of FIGS. 4A and 4B, the capacitive drop mass measurement system 100' as depicted in FIGS. 7A and 7B may include a shield electrode 124 to guard the electrodes 108*a*, 108*b* from electric fields from surrounding components that may introduce noise into the capacitance signals generated by the electrodes.

Referring now to FIG. 8, a flowchart of an embodiment of a method of operating the capacitive drop mass measurement system 100' of FIGS. 7A and 7B is depicted. The exemplary method of FIG. 8 enables test band thickness (and corresponding drop mass) measurements that are less susceptible to errors that may be introduced due to, for example, non-repeatable drum run out while only requiring a single test band formed on the drum surface thereby reducing the amount of ink required to determine drop mass. The method begins with the actuation of one or more ink jets to form a test band onto a surface of an imaging member (block 600). The controller then actuates the imaging member so that the test band is positioned under a first electrode of a dual electrode capacitance sensor positioned adjacent the imaging member and a bare, or un-inked area of the imaging member is positioned under a second electrode of the dual electrode capacitance sensor for a first round of capacitance measurements (block 604).

When the test band and the un-inked area have been appropriately positioned with respect to the first and second electrodes, the first electrode generates a first signal indicative of a first capacitance in a first gap between the first electrode and the surface of the imaging member, and the second electrode generates a second signal indicative of a second capacitance in a second gap between the second electrode and the surface of the imaging member (block 608). The controller is configured to stop the movement of the imaging member for a predetermined amount of time to enable the first and second electrodes to generate the first and second signals. In addition, the first and second signals may be generated substantially simultaneously by the first and second electrodes, respectively, while the imaging member is stopped.

The first and second signals indicative of the first and second capacitances are output to a controller. The controller is configured to convert the first capacitance to a first electrode-to-drum distance required to generate the first capacitance, and to convert the second capacitance to a second electrode-to-drum distance required to generate the second capacitance (block 610). During this round of measurements, the first capacitance corresponds to a test band capacitance and the second capacitance corresponds to a baseline capacitance. As mentioned above, the electrode-to-drum distance for the test band capacitance corresponds to an "apparent" distance between the electrode and surface of the imaging member resulting from the change in dielectric in the gap due to the presence of the test band. Once the first and second electrode-to-drum distances have been determined, the controller is configured to subtract the first electrode-to-drum distance from the second electrode-to-drum distance to arrive at an apparent distance reduction value for the first round of measurements (block 614).

The controller then actuates the imaging member so that the test band is positioned under the second electrode and a bare, or un-inked area of the imaging member is positioned under the first electrode of the dual electrode capacitance sensor for a second round of capacitance measurements (block 618). When the test band and the un-inked area have been appropriately positioned with respect to the second and first electrodes, respectively, the first electrode generates the first signal indicative of the first capacitance in the first gap, and the second electrode generates the second signal indicative of the second capacitance in the second gap. During the second round of measurements, the first capacitance corresponds to a baseline capacitance and the second capacitance corresponds to a test band capacitance. Once the first and second electrode-to-drum distances have been determined, the controller is configured to subtract the second electrode-to-drum distance from the first electrode-to-drum distance to arrive at an apparent distance reduction value for the second round of measurements (block 618).

The controller then actuates the imaging member so that the test band is positioned under the first electrode again and a bare, or un-inked area of the imaging member is positioned under the second electrode of the dual electrode capacitance sensor for a third round of capacitance measurements (block 620). When the test band and the un-inked area have been appropriately positioned with respect to the first and second electrodes, respectively, the first electrode generates the first signal indicative of the first capacitance in the first gap, and the second electrode generates the second signal indicative of the second capacitance in the second gap. During the third round of measurements, the first capacitance corresponds to a test band capacitance and the second capacitance corresponds to the baseline capacitance. Once the first and second electrode-to-drum distances have been determined, the controller is configured to subtract the first electrode-to-drum distance from the second electrode-to-drum distance to arrive at an apparent distance reduction value for the third round of measurements (block 620).

The apparent distance reduction value for the first, second, and third round of measurements are then combined and averaged to arrive at an average apparent distance reduction value (block 624). The average apparent distance reduction value may then be converted to a distance value indicative of an actual thickness of the test band based on the known dielectric constant of the ink used to form the test band (block 628). Once the actual thickness $T_I$ of the test band has been derived, the actual thickness $T_I$ may be used to calculate an average drop mass value $D_m$. If $T_1$ is in mm, R is the image resolution in drops-per-square-cm, and $D_i$ is the density of ink in grams-per-cubic-cm, then the drop mass $D_m$ in nano-grams per drop is:

$$D_m=1E8*T_i*D_i/R.$$

In alternative embodiments, the controller may include a processor for implementing any other suitable algorithm for calculating the average drop mass based on the detected base line capacitances and ink capacitances.

Once the average drop mass for a printhead or printheads of the imaging device is determined, one or more operating parameters of the printheads may be adjusted (block 634). In one embodiment, a determination may be made whether the average drop mass is within specifications. For example, the controller may be configured to compare the average drop mass to predetermined threshold values to determine if the drop mass within desired specifications. If the average drop mass is determined to not be within specifications, the controller may be configured adjust the voltage level or amplitude of all or a portion of the driving signal for the ink jets of the printhead or printheads until the average drop mass for the printhead or printheads is within desired specifications. The modification of the drive signals based on the average drop mass detected using the capacitive drop mass measurement system may require iterations. For example, once the average drop mass for the printhead(s) of an imaging device has been determined and modifications made to the drive signals to adjust the average drop mass, more test bands may be printed and the capacitance measured to determine if the adjustments were successful. The process may be repeated any suitable number of times until the average drop mass output by a printhead is within a desired range.

The method shown in FIG. 8 enables test band thickness measurement based on the difference in distances indicated by capacitances detected by the sensing electrodes of the dual electrode capacitance sensor when the test band is positioned under one of the electrodes. Doing all calculations based on the distance difference cancels out most drum run-out variations. If the distance of the drum surface to the probe assembly changes, both probe distances change by the same amount, so the difference remains unchanged.

Although the embodiment of the capacitive drop measurement system described above include two sensing electrodes that are configured to extend substantially the surface of the imaging member in the cross-process direction, in an alternative embodiment, the sensing electrodes may be divided in half down the drum center plane, for four sensing electrodes total. Each pair of electrodes on either side of the center plane of the drum may be operated separately to perform the method depicted in FIG. 8 and the results from the different pairs may be averaged to determine the test band thickness. Such a configuration enables compensation for sensor misalignment along the length of the drum, e.g., when one end of the sensor is closer to the drum than the other end.

It will be appreciated that variations of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An imaging device comprising:

an ink receiving surface of a drum that is movably supported within the imaging device;

at least one printhead including a plurality of ink jets, each ink jet being configured to eject drops of ink on the ink receiving surface of the drum;

a first electrode positioned adjacent the ink receiving surface, the first electrode being configured to output capacitance signals indicative of a capacitance in a first gap between the first electrode and the ink receiving surface of the drum;

a second electrode positioned adjacent the ink receiving surface, the second electrode being configured to output capacitance signals indicative of a capacitance in a second gap between the second electrode and the ink receiving surface of the drum; and a controller operatively connected to the first electrode and the second electrode to receive the capacitance signals from the first and the second electrodes, the controller being configured to:

operate at least one ink jet in the plurality of ink jets to eject drops of ink to form at least one test band on the ink receiving surface of the drum;

rotate the drum to slew the ink receiving surface at a predetermined rate of speed with the at least one test band formed on the ink receiving surface of the drum;

average a first test band capacitance and a second test band capacitance, the first test band capacitance being identified from a first round of capacitance measurements made with reference to a test band capacitance signal from the first electrode that is indicative of a capacitance with the test band on the image receiving surface being in the first gap and with reference to a baseline capacitance signal from the second electrode indicative of a capacitance in the second gap with no ink being on the image receiving surface in the second gap, and the second test band capacitance being identified from a second round of capacitance measurements made with reference to a baseline capacitance signal from the first electrode that is indicative of a capacitance in the first gap with no ink being on the image receiving surface in the first gap and with reference to a test band capacitance signal indicative of a capacitance in the second gap with the test band being on the image receiving surface in the second gap; and modify an operating parameter of the imaging device with reference to the average of the first test band capacitance and the second test band capacitance.

2. The imaging device of claim 1, the controller being further configured to:

correlate the average of the first test band capacitance and the second test band capacitance to a drop mass value, and the modification of the operating parameter of the imaging device is made with reference to the drop mass value.

3. The imaging device of claim 2, the controller being further configured to:

convert the test band capacitance signal from the first electrode to a first electrode-to-drum distance and the baseline capacitance signal from the second electrode to a second electrode-to-drum distance, subtract the first electrode-to-drum distance from the second electrode-to-drum to determine an apparent distance reduction value, convert the apparent distance reduction value to a test band thickness value using a dielectric constant of the ink used to form the at least one test band, and correlate the test band thickness value to the drop mass value.

4. The imaging device of claim 1, the controller being further configured to:

average a third test band capacitance with the first test band capacitance and the second test band capacitance, the third test band capacitance being identified from a third round of capacitance measurements made with reference to a test band capacitance signal from the first electrode that is indicative of a capacitance with the test band on the image receiving surface being in the first gap and with reference to a baseline capacitance signal from the second electrode indicative of a capacitance in the second gap with no ink being on the image receiving surface in the second gap.

5. The imaging device of claim 1 further comprising:

a shield electrode positioned adjacent the first electrode and the second electrode, the shield electrode being at the same electrical potential as the first electrode and the second electrode.

6. The imaging device of claim 1, wherein the drops of ink are essentially comprised of phase change ink.

7. A method of operating a printhead of an imaging device, the method comprising:

positioning a capacitance sensor adjacent an image receiving surface of an imaging device, the capacitance sensor being configured to detect a capacitance in a gap between the capacitance sensor and the image receiving surface;

ejecting drops of ink from at least one ink jet of at least one printhead of an imaging device to form a layer of ink on the image receiving surface;

detecting a capacitance in the gap with the layer of ink therein;

modifying an operating parameter of the imaging device based on the detected capacitance.

8. The method of claim 7, further comprising:

correlating the detected capacitance to a drop mass value for the at least one ink jet used to form the test band; and modifying an operating parameter of the imaging device based on the drop mass value.

9. The method of claim 8, further comprising:

actuating the image receiving surface to move the layer of ink into the gap prior to detecting the capacitance.

10. The method of claim 9, wherein the correlation of the detected capacitance to the drop mass value further comprises:

translating the detected capacitance to a thickness value for the layer of ink; and correlating the thickness value to the drop mass value.

11. The method of claim 10, wherein the actuation of the image receiving surface further comprises:

slewing the image receiving surface at a predetermined rate of speed; and wherein detecting a capacitance in the gap with the layer of ink therein further comprises:

generating capacitance signals indicative of the capacitance in the gap as the image receiving surface is slewed.

12. The method of claim 10, wherein the positioning of the at least one sensing electrode a predetermined distance from the image receiving surface further comprises:

positioning a first sensing electrode at a first circumferential adjacent the image receiving surface, the first sensing electrode defining a first gap between the first sensing electrode and the image receiving surface and being configured to detect a capacitance in the first gap; and positioning a second sensing electrode at a second circumferential adjacent the image receiving surface, the second sensing electrode defining a second gap between the first sensing electrode and the image receiving surface and being configured to detect a capacitance in the second gap.

13. The method of claim 12, wherein the actuation of the image receiving surface, detection of the capacitance, and correlation steps further comprise:

performing a first round of capacitance measurements by:

actuating the image receiving surface to move the layer of ink into the first gap such that an un-inked portion of the image receiving surface is positioned in the second gap;

detecting a first capacitance in the first gap using the first sensing electrode and detecting a second capacitance in the second gap using the second sensing electrode;

determining a thickness of the layer of ink by:

converting the first capacitance to a first electrode-to-drum distance and the second capacitance to a second electrode-to-drum distance;

subtracting the first electrode-to-drum distance from the second electrode-to-drum distance to arrive at an apparent distance reduction value;

translating the apparent distance reduction value to the thickness value for the layer of ink based on a dielectric constant of the ink used to form the layer.

14. The method of claim 13, further comprising:

performing a second round of capacitance measurements by:

actuating the image receiving surface to move the layer of ink into the second gap such that an un-inked portion of the image receiving surface is positioned in the first gap;

detecting a first capacitance in the first gap using the first sensing electrode and detecting a second capacitance in the second gap using the second sensing electrode;

determining a thickness of the layer of ink by:

converting the first capacitance to a first electrode-to-drum distance and the second capacitance to a second electrode-to-drum distance;

subtracting the second electrode-to-drum distance from the first electrode-to-drum distance to arrive at an apparent distance reduction value;

averaging the apparent distance reduction values from the first round of capacitance measurements and the second round of capacitance measurements to arrive at an average apparent distance reduction value;

translating the average apparent distance reduction value to the thickness value for the layer of ink based on the dielectric constant of the ink used to form the layer.

15. The method of claim 14, further comprising:

performing at least one more round of capacitance measurements by:

actuating the image receiving surface to move the layer of ink into the first gap such that an un-inked portion of the image receiving surface is positioned in the second gap;

detecting a first capacitance in the first gap using the first sensing electrode and detecting a second capacitance in the second gap using the second sensing electrode;

determining a thickness of the layer of ink by:

converting the first capacitance to a first electrode-to-drum distance and the second capacitance to a second electrode-to-drum distance;

subtracting the first electrode-to-drum distance from the second electrode-to-drum distance to arrive at an apparent distance reduction value;

averaging the apparent distance reduction values from the first, second, and at least one more round of capacitance measurements to arrive at an average apparent distance reduction value;

translating the average apparent distance reduction value to the thickness value for the layer of ink based on the dielectric constant of the ink used to form the layer.

16. The method of claim 7, wherein the ink comprises phase change ink; and the image receiving surface comprises an imaging drum.

17. The method of claim 7, the modification of the operating parameter further comprising:

adjusting a voltage level drive signals for at least one ink jet of the imaging device.

* * * * *